US010633155B2

(12) United States Patent
Sedgwick

(10) Patent No.: US 10,633,155 B2
(45) Date of Patent: Apr. 28, 2020

(54) DISPOSABLE FOOD CONTAINER WITH UTILITY LID

(71) Applicant: Inno-Pak, LLC, Delaware, OH (US)

(72) Inventor: Nathan A. Sedgwick, Aliso Viejo, CA (US)

(73) Assignee: Inno-Pak, LLC, Delaware, OH (US)

( * ) Notice: Subject to any disclaimer, the term of this patent is extended or adjusted under 35 U.S.C. 154(b) by 138 days.

(21) Appl. No.: 15/608,202

(22) Filed: May 30, 2017

(65) Prior Publication Data

US 2018/0290799 A1 Oct. 11, 2018

Related U.S. Application Data

(60) Provisional application No. 62/484,308, filed on Apr. 11, 2017.

(51) Int. Cl.

| | |
|---|---|
| ***B65D 51/24*** | (2006.01) |
| ***B65D 51/28*** | (2006.01) |
| ***A47G 19/06*** | (2006.01) |
| ***B65D 77/24*** | (2006.01) |
| ***B65D 43/02*** | (2006.01) |

(52) U.S. Cl.

CPC ..... *B65D 51/246* (2013.01); *A47G 19/06* (2013.01); *B65D 43/0212* (2013.01); *B65D 51/28* (2013.01); *B65D 77/245* (2013.01); *B65D 2543/00083* (2013.01); *B65D 2543/00101* (2013.01); *B65D 2543/00111* (2013.01); *B65D 2543/00138* (2013.01); *B65D 2543/00194* (2013.01); *B65D 2543/00203* (2013.01); *B65D 2543/00351* (2013.01); *B65D 2543/00527* (2013.01); *B65D 2543/00537* (2013.01); *B65D 2543/00731* (2013.01); *B65D 2543/00805* (2013.01)

(58) Field of Classification Search

CPC .... B65D 51/246; B65D 43/162; B65D 51/28; B65D 43/163; B65D 43/0212; B65D 43/16; B65D 2543/00527; B65D 2543/00351; B65D 2543/00296; B65D 2543/00203; B65D 2543/00194; B65D 2543/00138; B65D 2543/00111; B65D 2543/00101; B65D 2543/00083; B65D 2543/00805; B65D 2543/00731; B65D 2543/00537; B65D 77/245; A47G 19/06

USPC ..... 220/574.1, 521

See application file for complete search history.

(56) References Cited

U.S. PATENT DOCUMENTS

| | | | | |
|---|---|---|---|---|
| 700,653 | A * | 5/1902 | Jobson | A47G 21/145 215/227 |
| 1,369,999 | A | 3/1921 | Hector | |
| 2,301,510 | A | 11/1942 | Bolen | |
| 2,740,349 | A | 4/1956 | De Gonia | |
| 3,381,876 | A * | 5/1968 | Biggins | A47G 23/06 220/574 |
| 3,565,245 | A | 2/1971 | Asher | |
| 3,624,787 | A | 11/1971 | Newman | |

(Continued)

FOREIGN PATENT DOCUMENTS

| | | | | |
|---|---|---|---|---|
| GB | 2154993 A * | 9/1985 | ..... | B65D 83/303 |

*Primary Examiner* — James N Smalley

(74) *Attorney, Agent, or Firm* — Ward and Smith, P.A.; Ryan K. Simmons

(57) ABSTRACT

A disposable food container is configured with a lid that enables similar containers to be securely stacked and enables easy verification that loaded and stacked containers contain utensils and/or condiments.

12 Claims, 12 Drawing Sheets

(56) References Cited

U.S. PATENT DOCUMENTS 3,679,093 A 7/1972 Chang
3,954,178 A 5/1976 Mason, Jr.
3,955,742 A 5/1976 Marshall
D242,108 S 11/1976 Dart
4,232,785 A * 11/1980 Lucas ..... A45D 27/22 132/289
4,270,660 A 6/1981 Putt
4,300,700 A 11/1981 Chang
D266,818 S 11/1982 Trombly
D282,338 S 1/1986 Putt
4,572,423 A 2/1986 Spencer
4,603,825 A 8/1986 Kotliar
4,896,820 A 1/1990 Harrington
4,903,848 A * 2/1990 Chattman ..... B65D 51/246 15/145
4,930,637 A 6/1990 DeRoseau
5,005,704 A 4/1991 Martin
D318,985 S 8/1991 Szablak
D323,616 S 2/1992 Mueller
5,275,281 A * 1/1994 Ebeling ..... B65D 81/113 206/373
5,301,697 A * 4/1994 Gueret ..... A45D 33/00 132/293
D350,046 S 8/1994 Zimmerman
5,415,309 A * 5/1995 Wang ..... B65D 21/023 220/212
5,705,212 A 1/1998 Atkinson
5,722,558 A * 3/1998 Thompson ..... B65D 51/28 206/217
5,971,168 A 10/1999 Proulx
6,003,710 A 12/1999 Huang
D418,716 S 1/2000 Haley
D419,371 S 1/2000 Haley
6,273,278 B1 8/2001 Enyedy
D448,288 S 9/2001 Zettle
D452,155 S 12/2001 Stodd
6,354,433 B1 * 3/2002 Mattes ..... A45D 27/28 206/228
6,357,619 B1 * 3/2002 Schaefer ..... B65D 43/0212 220/709
6,412,653 B1 7/2002 Waterhouse
D465,382 S 11/2002 Wolf
6,604,645 B1 8/2003 Vaupotic
D480,264 S 10/2003 de Groote
6,688,469 B1 2/2004 Barnes
D491,455 S 6/2004 Li
6,840,395 B2 1/2005 Agarwal
D502,050 S 2/2005 Munson
7,017,774 B2 3/2006 Haedt
D531,054 S 10/2006 Sagel
D549,050 S 8/2007 Spencer
D550,503 S 9/2007 Liu
D551,496 S 9/2007 Ablo
D563,166 S 3/2008 Woolfolk
D563,785 S 3/2008 Maki
D564,287 S 3/2008 Bouveret
D653,907 S 2/2012 Backaert
D660,659 S 5/2012 Cohen
8,317,024 B1 * 11/2012 Persi ..... B65D 81/3205 206/508
D687,705 S 8/2013 Krupa
D688,091 S 8/2013 Golota
D694,062 S 11/2013 Andres
D694,063 S 11/2013 Andres
8,985,382 B2 3/2015 Vernon
D736,616 S 8/2015 Suen
D741,642 S 10/2015 Yessin
D748,498 S 2/2016 Pipes
D752,978 S 4/2016 Zabeleta
D759,427 S 6/2016 Wiggins
D769,132 S 10/2016 Tilahun
D771,432 S 11/2016 Affatato
D772,002 S 11/2016 Affatato
D789,784 S 6/2017 Hendricks
D792,760 S 7/2017 Foster
D794,444 S 8/2017 Chen
D795,069 S 8/2017 Haddad
D795,070 S 8/2017 Haddad
D796,908 S 9/2017 Dennis
D801,176 S 10/2017 Lynd
D803,677 S 11/2017 Yang
D809,335 S 2/2018 Bouveret
D814,922 S 4/2018 Magana
2004/0035867 A1 2/2004 Schultz
2009/0120942 A1 * 5/2009 Vovan ..... B65D 43/0239 220/574.1
2009/0200315 A1 * 8/2009 Blondeel ..... A47G 19/06 220/574.1
2012/0031901 A1 2/2012 Dudson
2012/0061409 A1 * 3/2012 Fioritto ..... A47G 19/2272 220/708
2012/0138608 A1 6/2012 Rusnak
2014/0021206 A1 * 1/2014 Vernon ..... A47G 19/06 220/574.1
2014/0238982 A1 8/2014 Dabney-Wiggs
2017/0283156 A1 * 10/2017 Weinstein ..... F25D 3/08
2018/0127178 A1 * 5/2018 Bosio ..... A47J 47/02

* cited by examiner

DISPOSABLE FOOD CONTAINER WITH UTILITY LID

FIELD OF THE INVENTIONS

The inventions described below relate to the field of disposable containers for food.

BACKGROUND OF THE INVENTIONS

Restaurants, supermarkets and other food service operators generally provide utensils and condiments as separate units independent of a food container. As separate units, utensils and condiments are often placed insecurely in a takeout bag alongside the food container, on top of the food container, or inside the container with the food.

All the generally used alternatives for packaging utensils and condiments with a food container provide ample opportunity for the utensils and condiments to become inadvertently contaminated or rendered unusable during storage or transport.

There are also reusable containers for food storage and transportation that include separate spaces for condiments and or utensils in the container or inside the utility lid. These containers do not provide solutions for commercial food service because they are expensive and the lids are not configured for secure stacking and transportation when loaded and stacked and the lids are not transparent to enable easy confirmation that utensils and condiments are included in a food container when the food containers are loaded and stacked for storage and sale.

SUMMARY

The devices and methods described below provide for a single use food container that is configured with a lid that enables similar containers to be securely stacked for storage and transportation and enables easy verification that loaded and stacked containers contain utensils and/or condiments. A loaded container has food in the food storage space, a utensil in the utensil recess and one or more condiments in the condiment recess as illustrated in FIG. 6. A loaded lid has one or more utensils in the utensil recess and, if present, one or more condiments in the condiment recess.

The disposable food container with a utility lid may be a hinged single piece container or a two-piece container with a transparent lid that provides one or more recesses in the lid for secure storage of a utensil and or suitable condiments. The recesses are accessible from the outside of the lid and extend into the food storage space such that when loaded containers or lids are stacked, the presence of utensils and/or condiments may be easily verified from the side of the stacked containers by looking through the side of the transparent lid.

For a utensil, there is a recess on the top of the lid, accessible from the outside of the lid, in the shape of the utensil itself so that it sits flush or below the central portion of the lid. Along the sides of the utensil recess there are ridges, extensions, teeth or other suitable elements that overhang the utensil recess slightly to snap fit the utensil or utensils in the utensil recess. The utensil will snap into the recess and remain secure unless purposefully removed by a user. Utensils may be one or more of forks, spoons, knives, sporks and or chopsticks.

There may also two recesses formed on the lid adjacent to the utensil recess to enable a user to insert one or more fingers into the recesses, for example, one on each side of the utensil, to grasp the utensil from the bottom and pull it out for use. This configuration specifically allows the user to fit their finger under the utensil itself for easy grasping and removal of the utensil.

The disposable food container with a utility lid is also designed specifically for stacking. The central lid portion is recessed below the outer lid rim to engage the base of lower portion of similar containers. This allows loaded containers to be stacked several units high with the utensils and condiments secured in the top of the lid. Similarly, loaded lids may be stacked at the manufacturer and then packaged together such that the existence of the utensils in the utensil recesses may be easily verified by sight through the transparent sides of the lids.

When a user approaches a stack of loaded, single use food containers with a utility lids at the supermarket or other commercial establishment, the transparent lids enable a user to see from the side of the containers that the containers have a utensil and/or condiments included. By being immediately apparent, it enhances the customer or user experience by saving time and eliminating the need to open or unstack the containers to determine if utensils and or condiments are included with each container.

The lid design can be configured for almost any variation or combination of utensils and condiments. The lid may include two separate slots or utensil recesses for a fork and knife if the particular food product requires those utensils. If the food product is a soup, the lid may be configured to accomodate a spoon or any other suitable combination of utensils. The lid may include two holders or recesses for portion cups and one holder or recess for a utensil. For example, if the container holds a sandwich, the restaurant may include both mustard and mayonnaise as condiments, along with a knife to spread the condiments and cut the sandwich. Alternatively, the lid may include several holders, openings or spaces for portion cups and none for utensils. This enables an ice cream parlor to offer ice cream in a container with a utility lid that may accommodate several different type of toppings (gummy bears, M&Ms, etc) in portion cups on the top of the container. The container itself, both base and lid, as well as the utensils and portion cups (for condiments) can be made of many different transparent materials, including but not limited to: plastics such as PP, PET, PS, OPS, PLA, CPLA, ABS etc. The bottom, bowl or base of the container may be molded fiber such as sugarcane, bamboo, wood, etc. or any suitable plastic.

The utensils and condiments, as well as the portion cups used to hold condiments, can be of any suitable size.

DETAILED DESCRIPTION OF THE INVENTIONS

Figure 1:
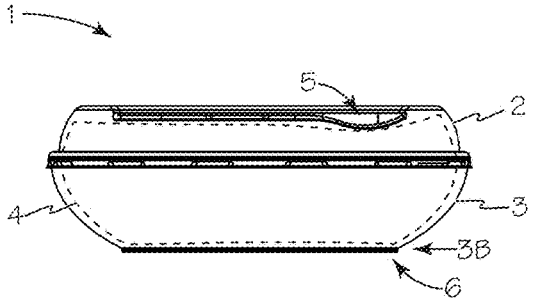
FIG. 1 is a side view of a disposable food container with a utility lid with a fork in the lid recess.

FIG. 1 is a side view of disposable food container 1 which includes utility lid 2 engaging bowl 3 to enclose food space 4 inside the container. Utility lid 2 includes one or more recesses such as utensil recess 5 in the central portion of the lid which extend into food space 4. The one or more recesses are accessible from the outside of the utility lid and, preferably, isolated from the food space inside the lid. Utility lid 2 may be formed of any suitable transparent plastic such as PP, PET, PS, OPS, PLA, CPLA, ABS etc. Bowl 3 may be formed using any suitable technique and disposable material such as molded fiber using materials such as sugarcane, bamboo, wood, etc. or molded using any suitable plastic. Bowl 3 is formed to include bowl rim 6 which is formed into the bottom surface 3B of the bowl.

Figure 2:
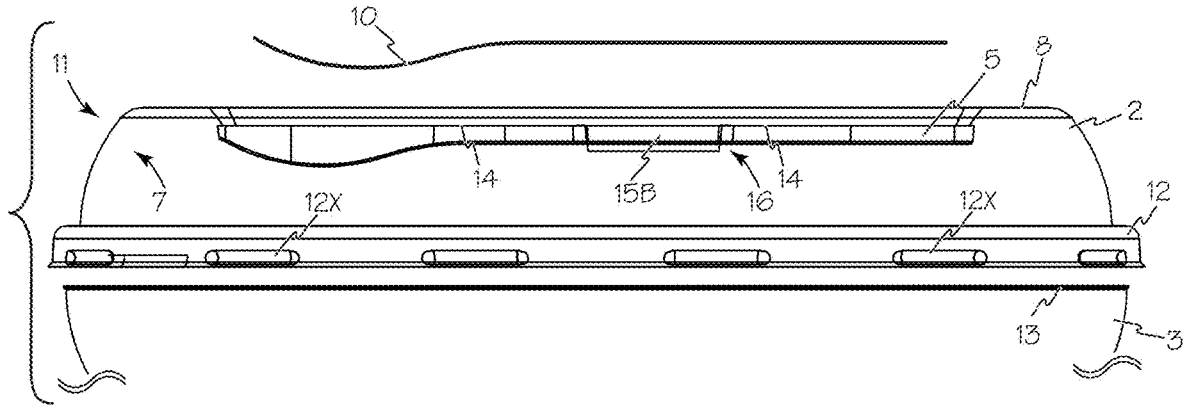
FIG. 2 is a side view of the utility lid of the food container of FIG. 1 separated from the bowl rim and the fork separated from the lid.

FIG. 2 illustrates utility lid 2 with utensil 10 removed from utensil recess 5. Utility lid 2 is formed of transparent material to enable a clear view from outside 11 of container through the side of the lid into the inside 7 of the container in food space 4 and enable a view of utensil recess 5 to enable easy verification of the contents of the container and utensil recess 5 when loaded containers are stacked together. In the context of this application, a disposable container is "loaded" when food space 4 contains food, utensil recess 5 contains one or more utensils, and rim 12 engages rim 13 of bowl 3. Rim 12 includes any suitable means for snap fit engaging bowl rim 13. Suitable means include tabs, flaps or protuberances to engage slots, rims, ridges or sockets in bowl rim 13. Engagement means may also include a plurality of ridges, clips, edges, extensions, bosses, protrusions, teeth such as engagement ridges 12X.

Along the sides of utensil recess 5 there are two or more ridges, edges, extensions, bosses, protrusions, teeth or other suitable elements such as ridges 14 that overhang a portion of the utensil recess to snap fit engage the utensil in the utensil recess. The utensil will snap into the recess and remain secure unless purposefully removed by hand. Utensils such as utensil 10 may be one or more forks, spoons, knives, sporks and or chopsticks.

Figure 3:
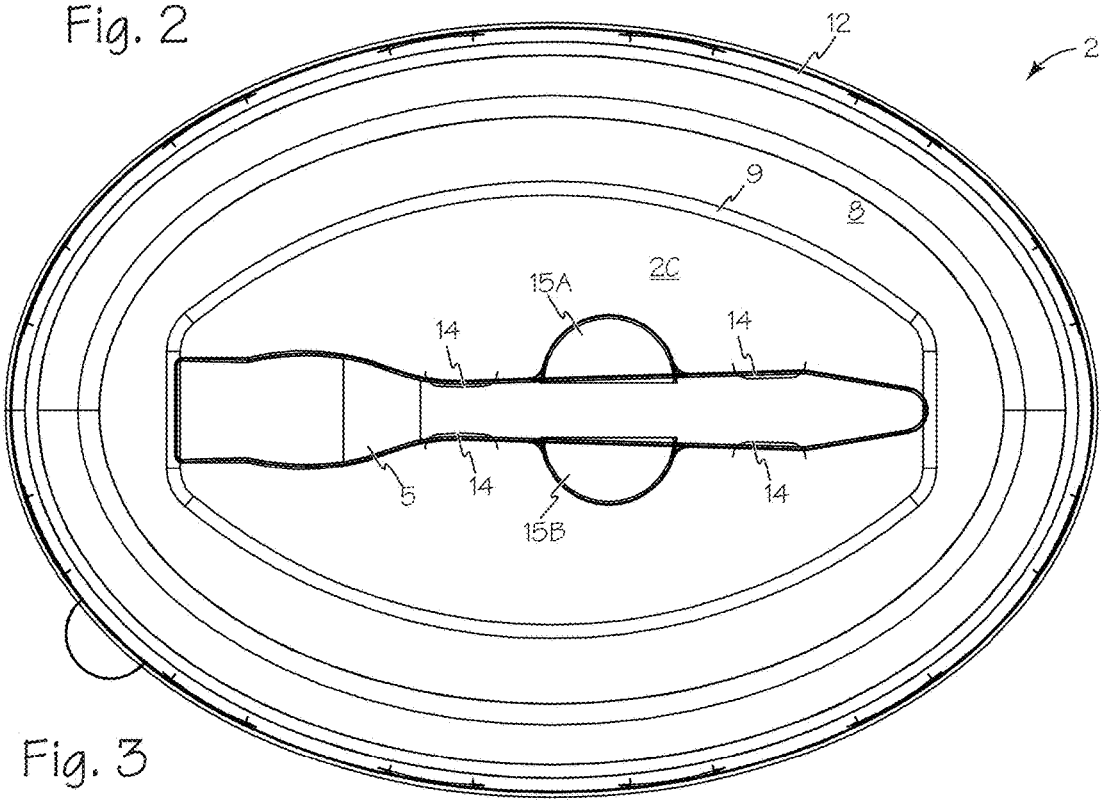
FIG. 3 is a top view of the disposable food container with a utility lid of FIG. 1.

As illustrated in FIGS. 2 and 3 there are also two recesses such as finger recesses 15A and 15B in the lid adjacent to the utensil recess that extend further into the food space, as illustrated at edge 16 to enable a person to insert two fingers, one on each side of the utensil, to grasp the utensil from the bottom and pull it out for use. This configuration specifically allows the user to fit their finger under the utensil itself for easy grasping and removal of the utensil.

Figure 4:
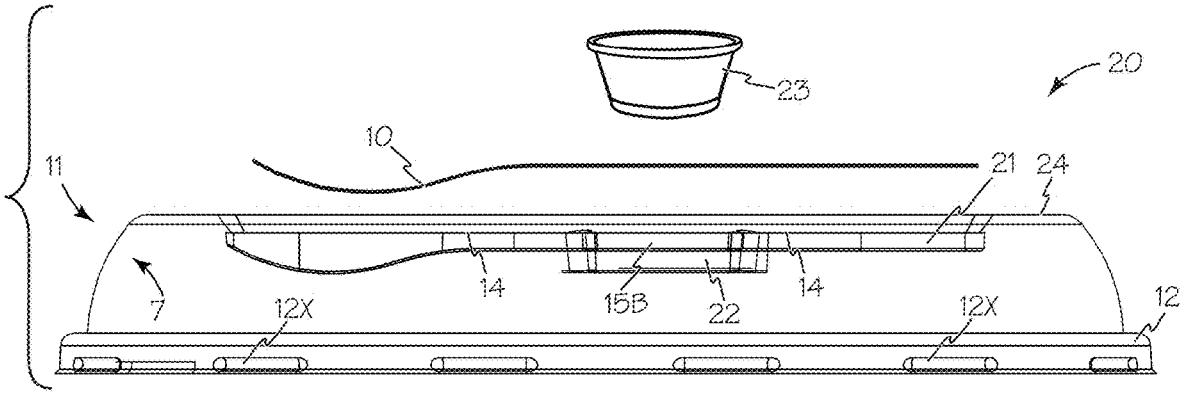
FIG. 4 is a side view of a utility lid configured for a utensil and a condiment cup.
Figure 5:
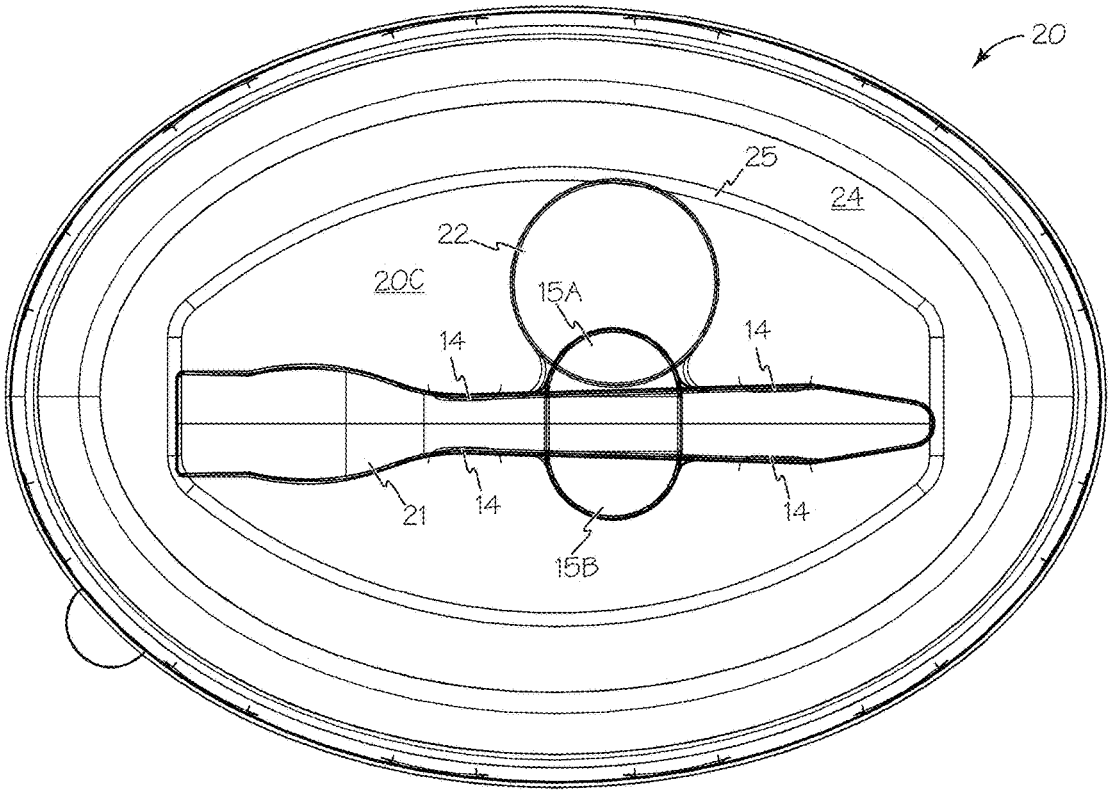
FIG. 5 is a top view of the utility lid of FIG. 4.

Referring now to FIGS. 4 and 5, utility lid 20 includes utensil recess 21 for engaging and securing one or more utensils 10 and one or more condiment recesses such as condiment recess 22 for engaging and securing a condiment container such as condiment container 23.

Utility lids 2 and 20 have central portion of the lids, portions 2C and 20C respectively recessed below the upper edge of the lids, 8 and 24 respectively, to create a rim such as rims 9 and 25 to securely engage bowl rim 6 of bowls such as bowl 3 when loaded containers are stacked.

Figure 6:
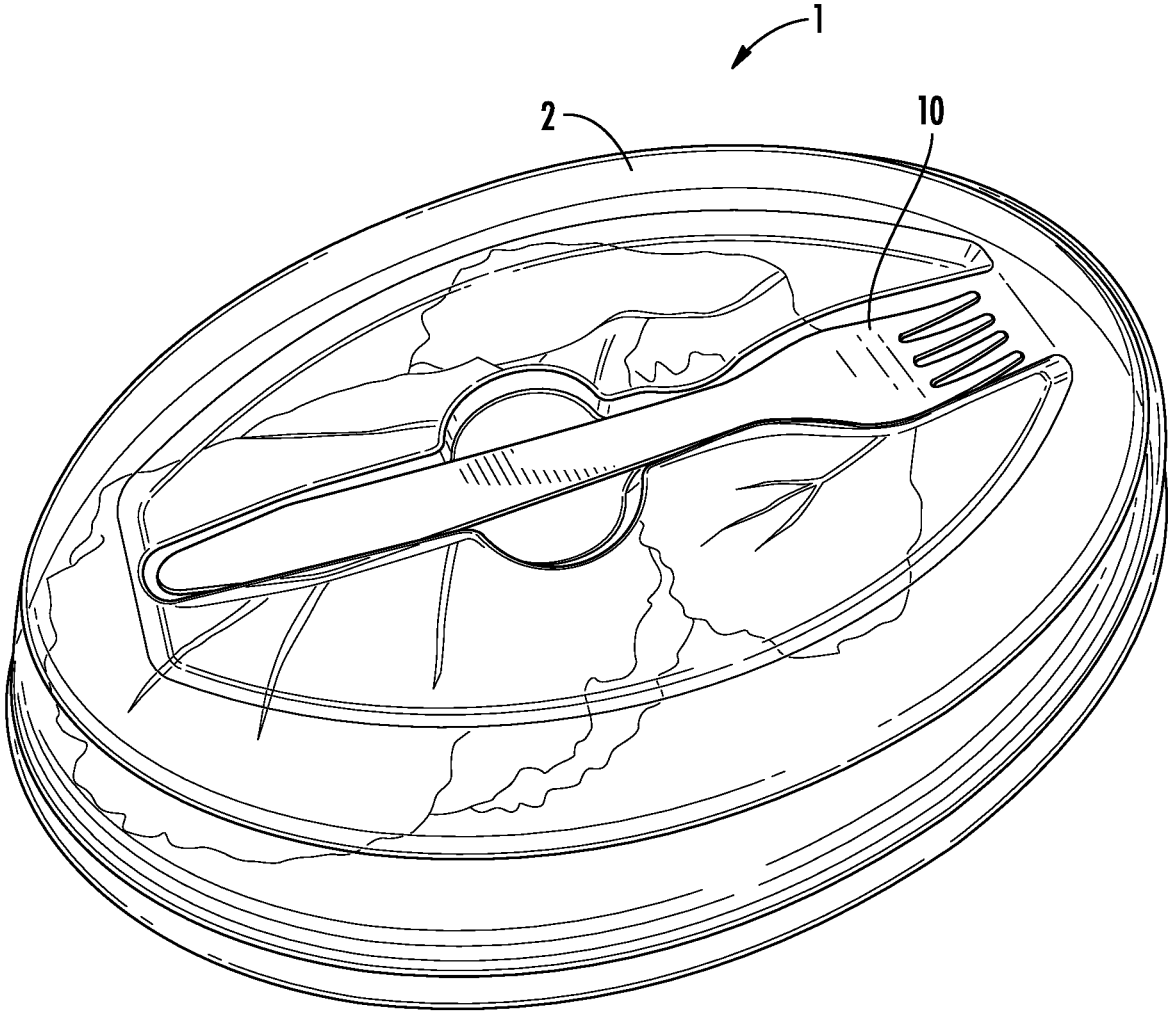
FIG. 6 is a photograph of a loaded disposable food container with utility lid.

FIG. 6 illustrates loaded disposable food container 1 with utility lid 2 and utensil 10.

Figure 7:
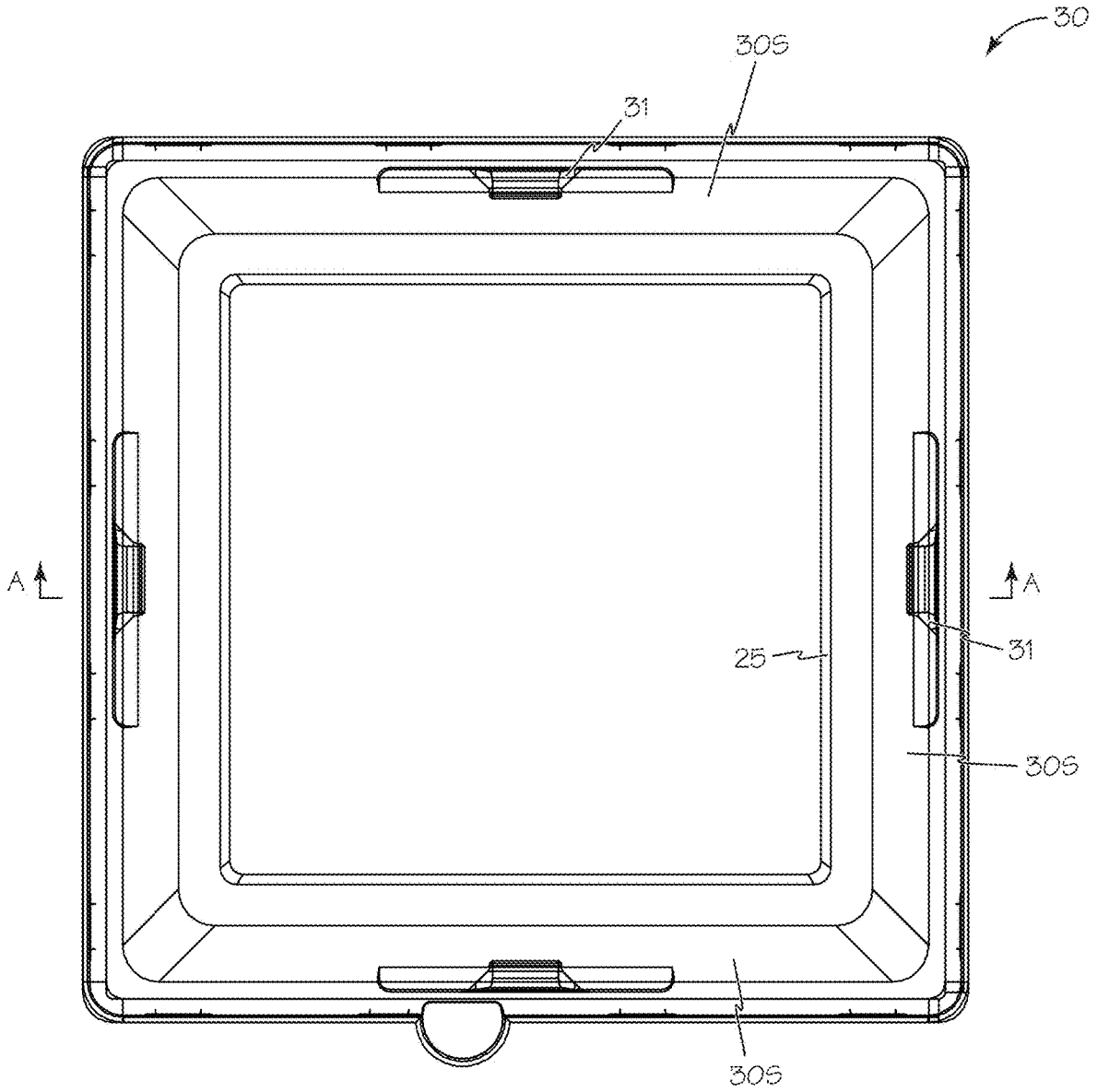
FIG. 7 is a top view of a utility lid with utensil clips on the side of the lid.
Figure 8:
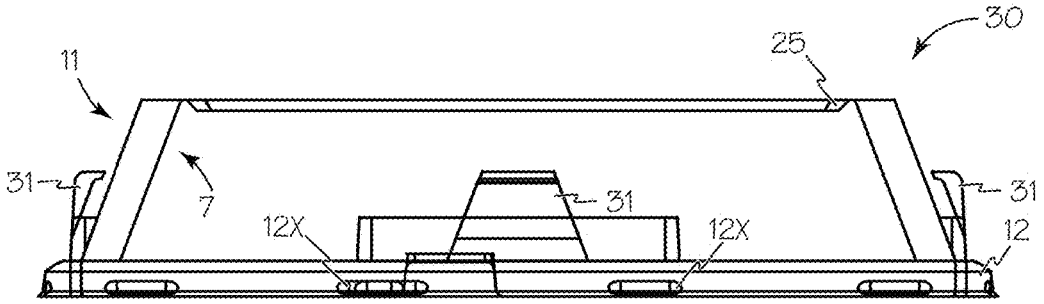
FIG. 8 is a side view of the utility lid of FIG. 7.
Figure 9:
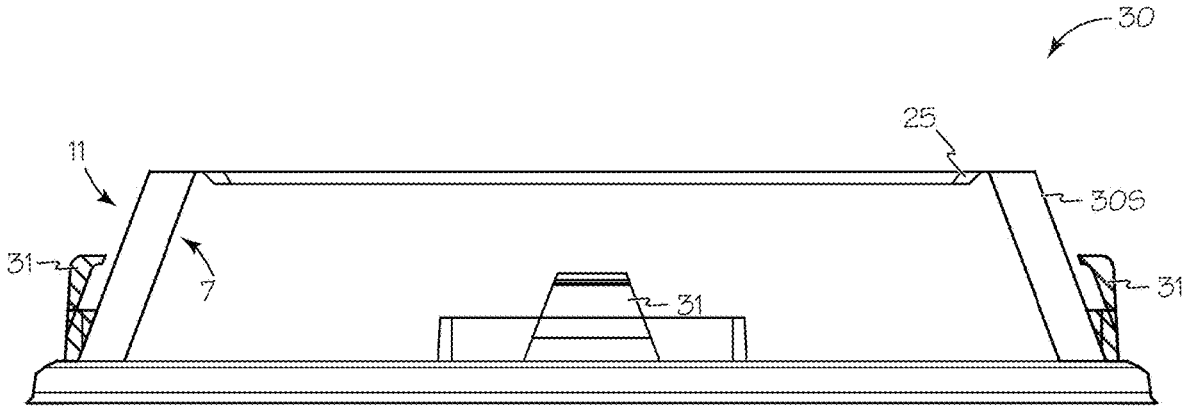
FIG. 9 is a cross-section view of the utility lid of FIG. 7 taken along A-A.

FIGS. 7, 8 and 9 illustrate utility lid 30 which includes one or more side or utensil clips such as clip 31. Utensil clips 31 are configured to engage items between the utensil clip and lid side 30S. Items such as utensils, napkins and or condiments or a pre-wrapped package containing one or more utensils, a napkin and one or more condiments may be secured between utensil clips 31 and lid side 30S.

Figure 10:
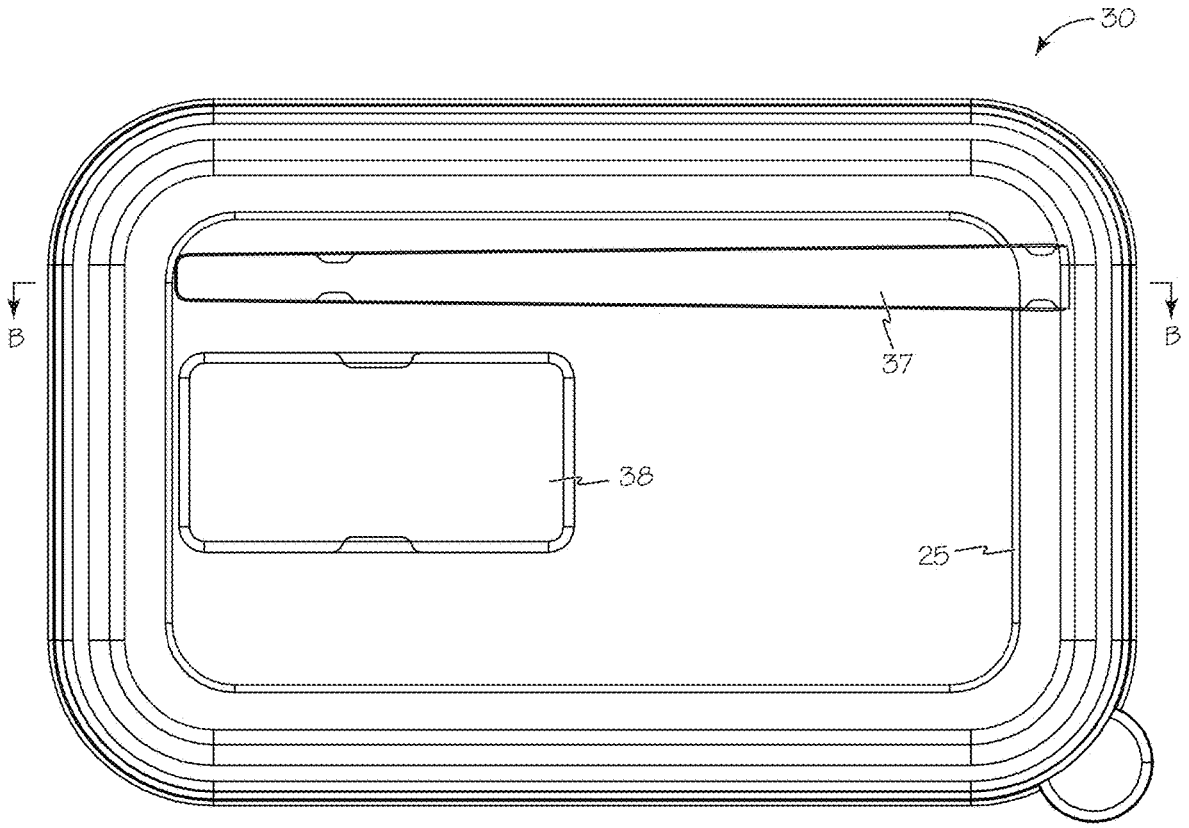
FIG. 10 is a top view of a utility lid configured for chopsticks and a condiment space.
Figure 11:
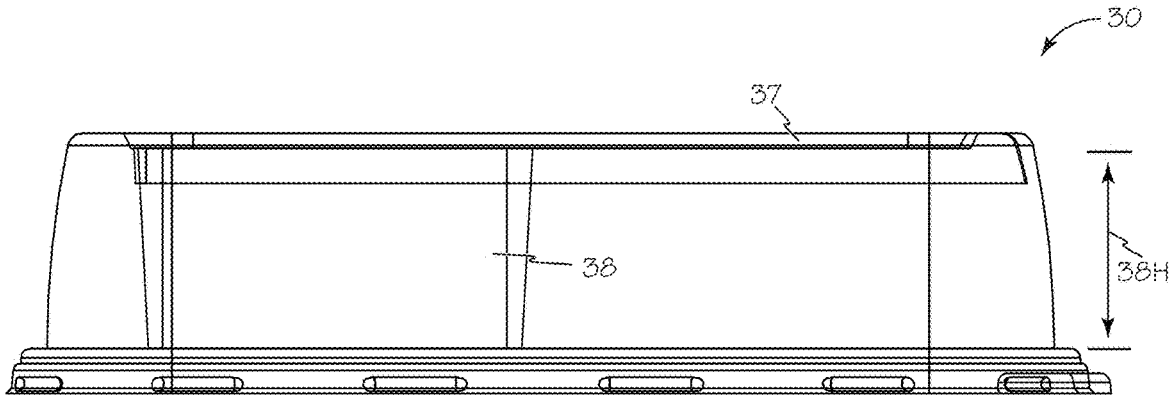
FIG. 11 is a side view of the utility lid of FIG. 10.
Figure 12:
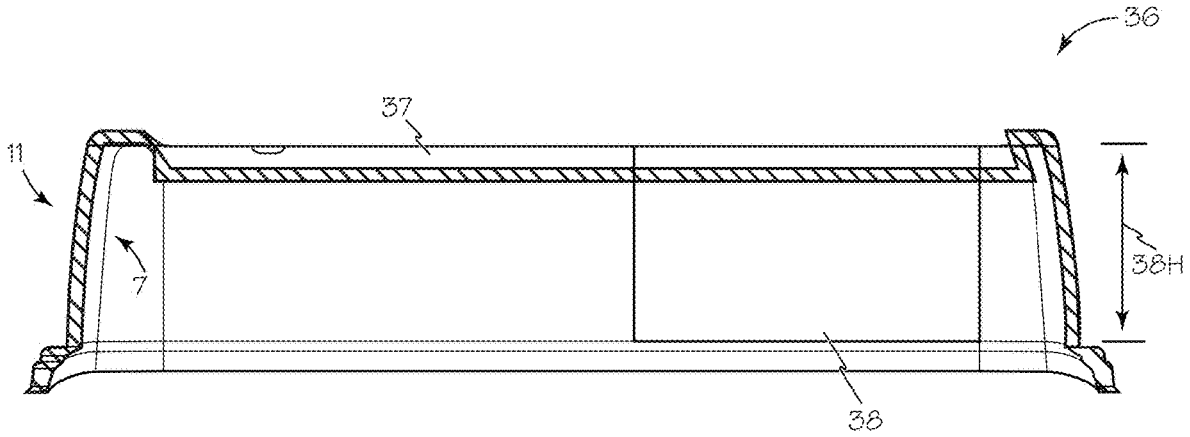
FIG. 12 is a cross-section view of the utility lid of FIG. 10 taken along B-B.

FIGS. 10, 11 and 12 illustrate utility lid 36 which includes utensil recess 37 configured to engage chopsticks and condiment recess 38 which has depth 38H to enable condiments to be directly poured into the condiment recess to enable dipping food items such as sushi, sashimi or other suitable food such as French fries or onion rings.

Figure 13:
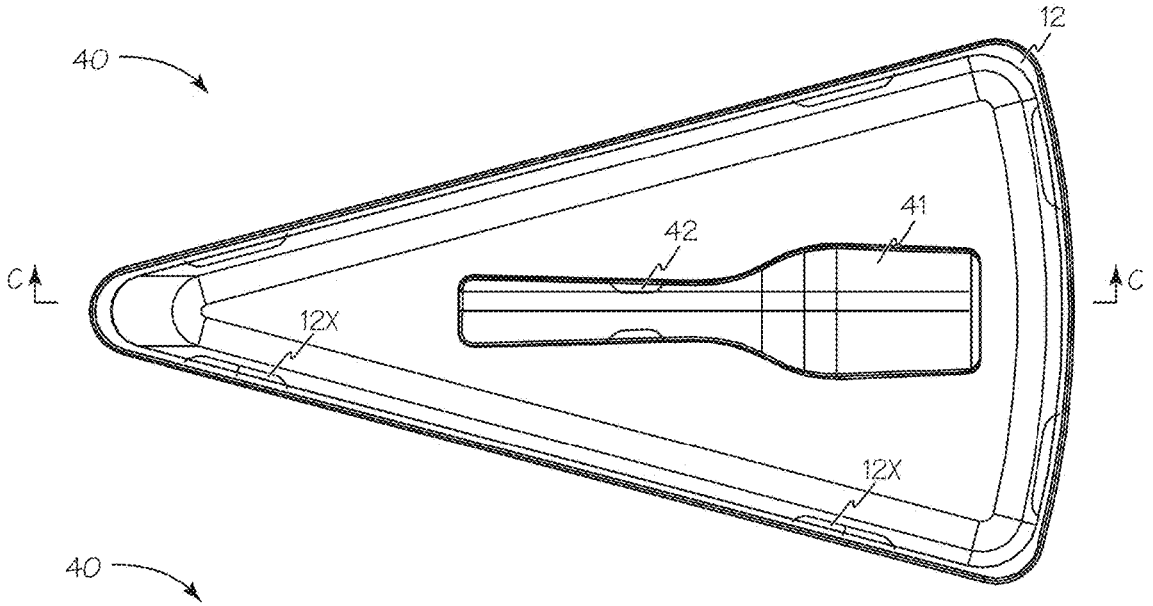
FIG. 13 is a top view of a triangular utility lid configured for engaging a utensil.
Figure 14:
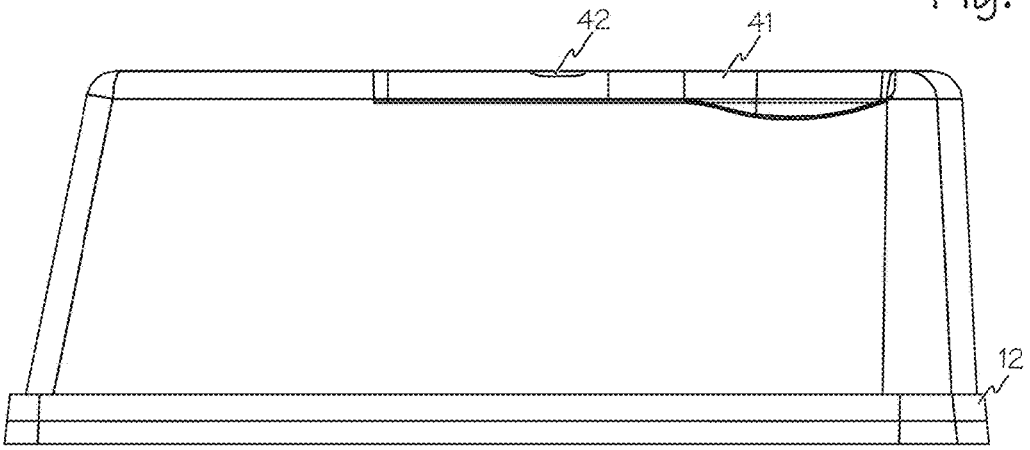
FIG. 14 is a side view of the utility lid of FIG. 13.
Figure 15:
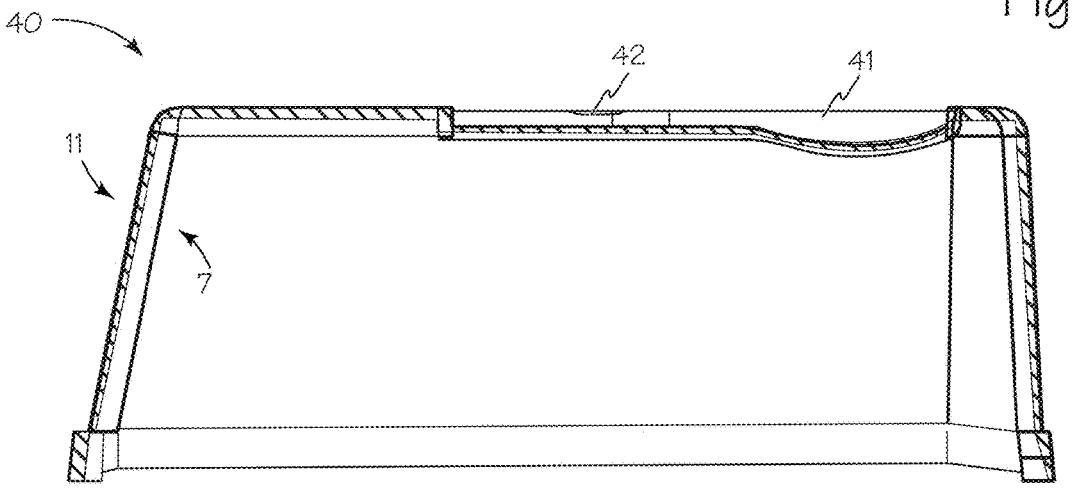
FIG. 15 is a cross-section view of the utility lid of FIG. 13 taken along C-C.
Figure 16:
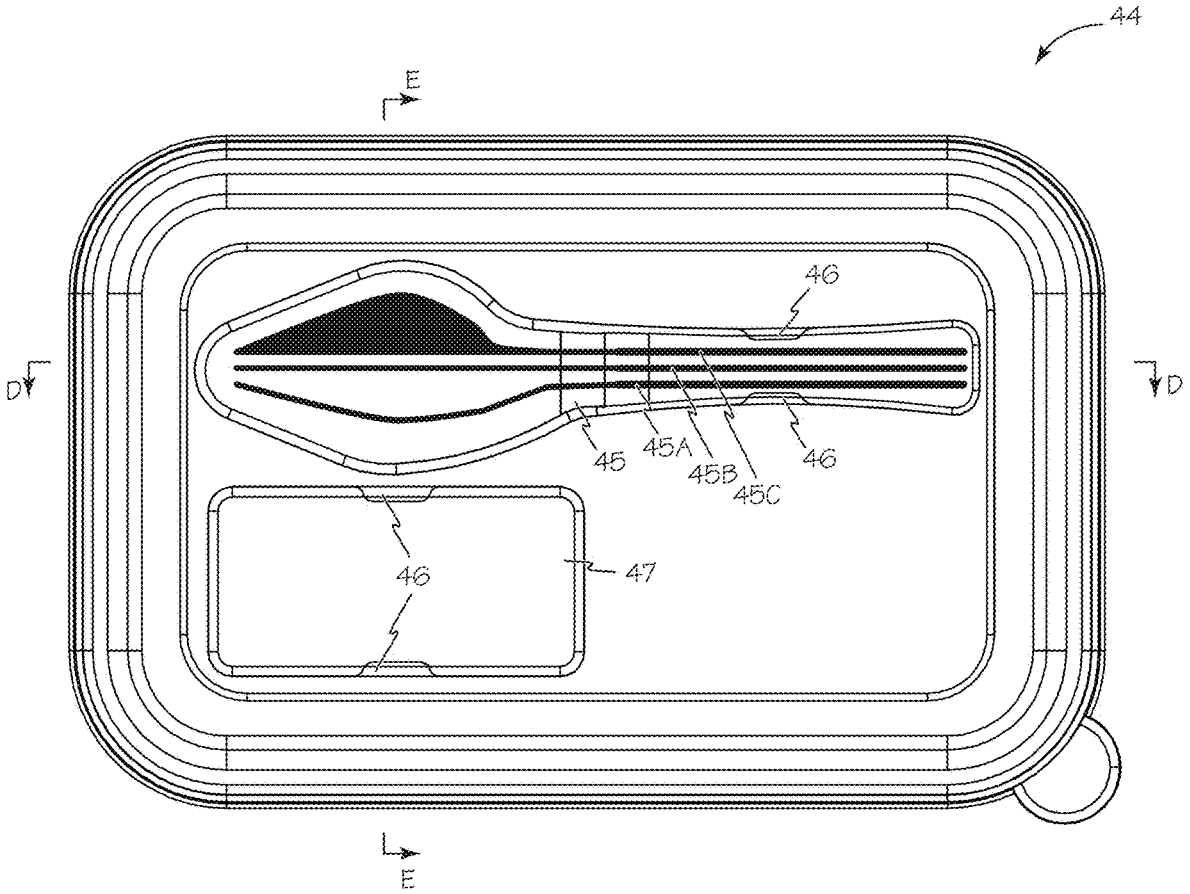
FIG. 16 is a top view of a utility lid configured for multiple utensils and a condiment space.
Figure 17:
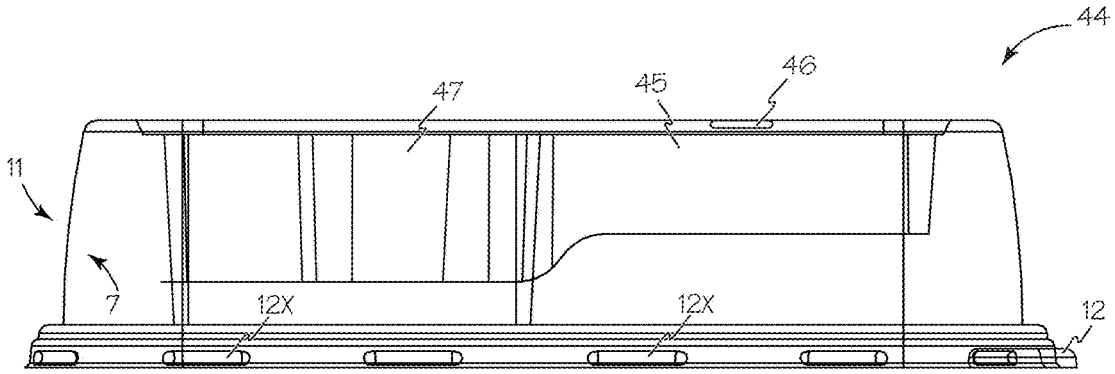
FIG. 17 is a side view of the utility lid of FIG. 17.
Figure 18:
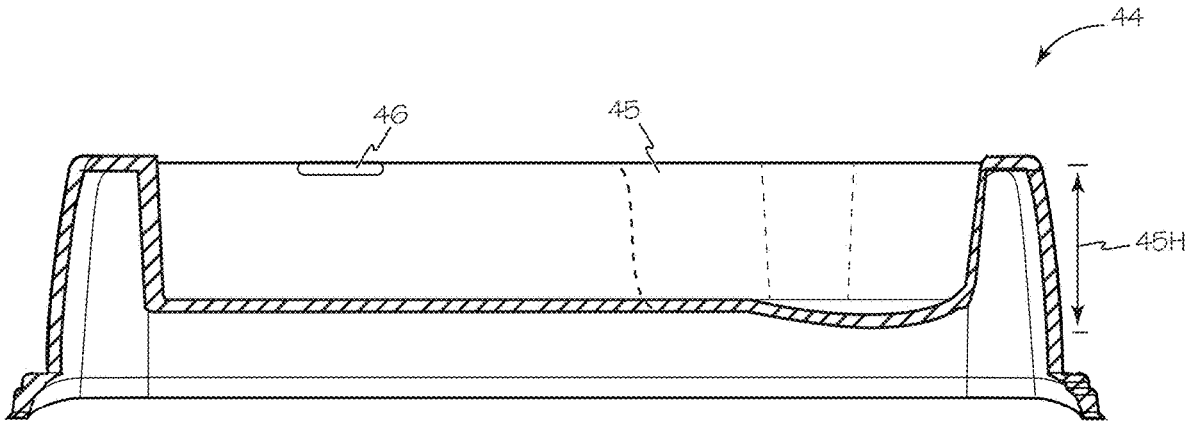
FIG. 18 is a cross-section view of the utility lid of FIG. 17 taken along D-D.
Figure 19:
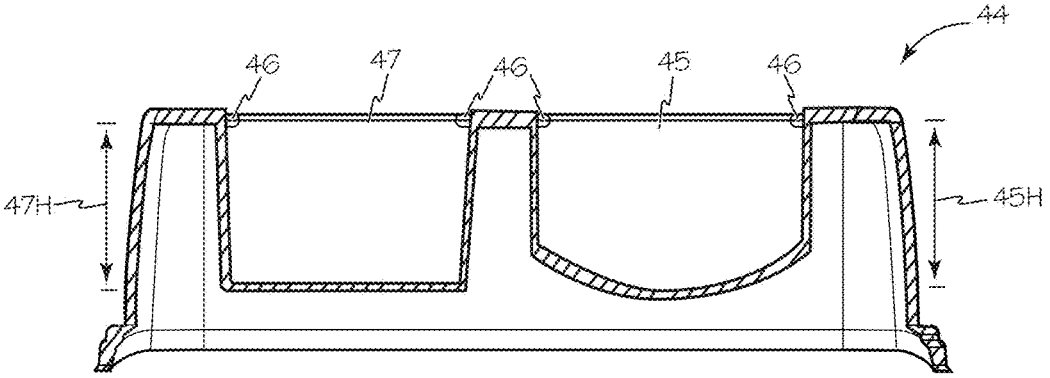
FIG. 19 is a cross-section view of the utility lid of FIG. 17 taken along E-E.
Figure 20:
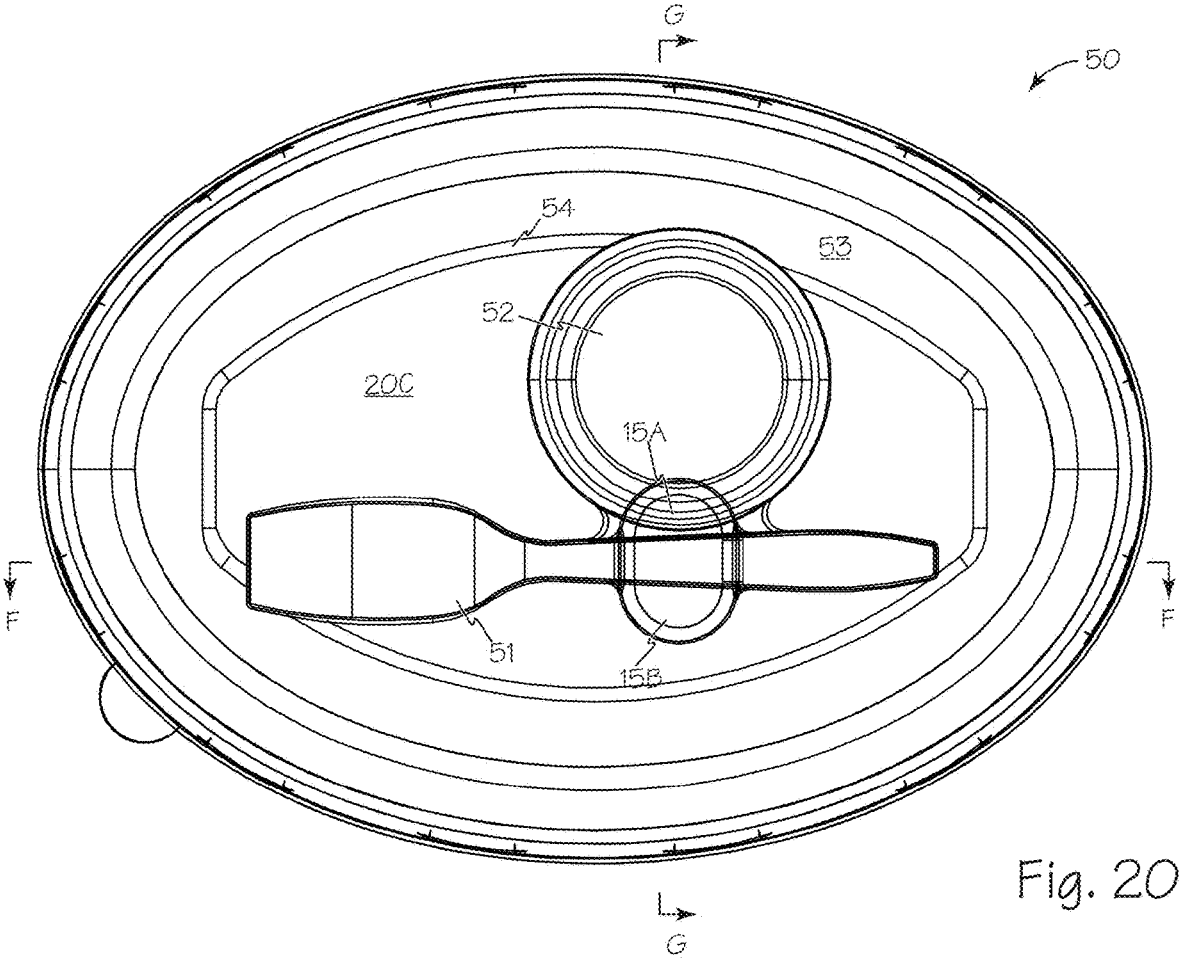
FIG. 20 is a top view of an oval utility lid configured for multiple utensils and a deep condiment space.
Figure 21:
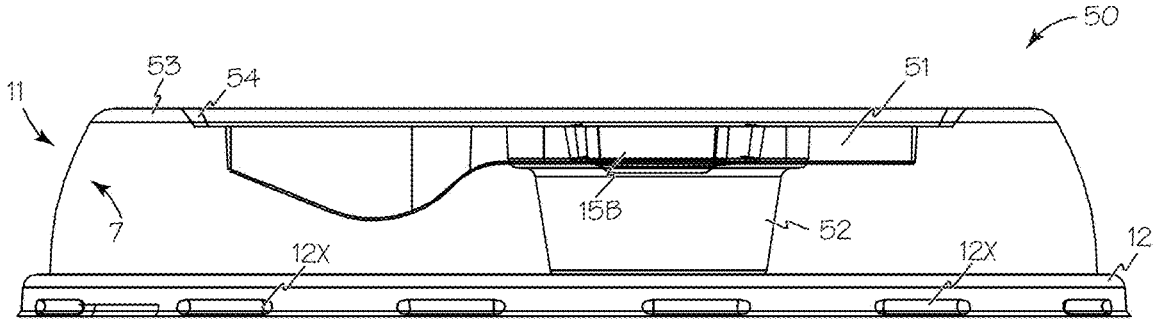
FIG. 21 is a side view of the utility lid of FIG. 20.
Figure 22:
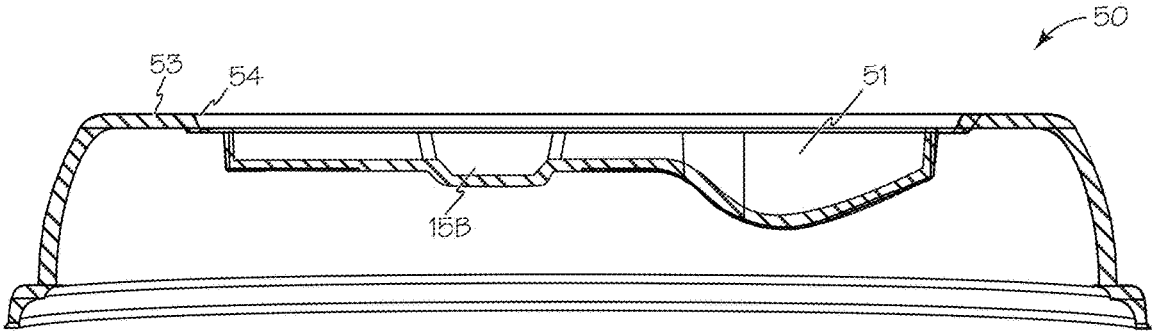
FIG. 22 is a cross-section view of the utility lid of FIG. 20 taken along F-F.
Figure 23:
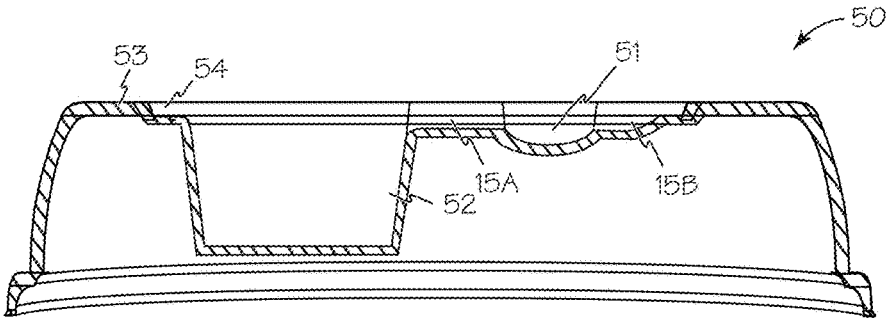
FIG. 23 is a cross-section view of the utility lid of FIG. 20 taken along G-G.

FIGS. 13, 14 and 15 illustrate utility lid 40 which is shaped to enclose wedge shaped food items such a pie slices. Utility lid 40 includes utensil recess 41 with retaining ridges 42 to secure any suitable utensil in utensil recess 41.

FIGS. 16, 17, 18 and 19 illustrate utility lid 44 which includes utensil recess 45 having a depth 45H to enable multiple utensils, such as utensils 45A, 45B and 45C, to be secured in the recess by retaining ridges 46. Condiment recess 47 has depth 47H to enable putting condiments directly into the condiment recess to enable food items to be dipped into the condiments.

FIGS. 20, 21, 22 and 23 illustrate utility lid 50 includes utensil recess 51 for engaging and securing one or more utensils and one or more condiment recesses such as condiment recess 52 for engaging and securing a condiment container. Utility lid 50 is an alternate configuration of utility lid 20 of FIGS. 4 and 5. Utensil recess 51 and condiment recess 52 have greater depths than the utensil and condiment recesses of utility lid 20. Any suitable depth variation or recess configuration may be used to accommodate and engage any suitable number and configuration of utensils or other tools and condiments or other material corresponding to the contents enclosed by the utility or utility lid.

Utility lid 50 includes central portion 50C recessed below the upper edge 53 of the lid to create a rim such as rim and 54 to securely engage a bowl rim of a container stacked on utility lid 50.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A single use utility lid for a food container comprising:

a transparent plastic lid having an inside and an outside and means for engaging the food container;

a first recess accessible from the outside of the transparent plastic lid with one or more retaining ridges, wherein the first recess is configured to retain a fork or spoon type utensil therein such that when retained therein the fork or spoon type utensil is substantially flush with or below a top surface of the lid; and a second recess disposed at about mid-length of the first recess, wherein outer opposing edges of the second recess extends out past a first side and a second side of the first recess, and wherein the second recess has a depth deeper than the depth of the first at that point, and further wherein the portions of the second recess extending out past the first side and the second side of the first recess are each configured to receive a portion of a user's fingertip therein.

2. The utility lid of claim 1 further comprising:

a lid rim.

3. The utility lid of claim 1 further comprising:

a third recess, wherein the third recess is configured to accept a first condiment receptacle therein.

4. The utility lid of claim 3 further comprising:

a fourth recess, wherein the fourth recess is configured to accept a second condiment receptacle therein.

5. The utility lid of claim 1 wherein the utility lid is hinged together with the food container.

6. The utility lid of claim 3 wherein the utility lid is hinged together with the food container.

7. The utility lid of claim 2 wherein the utility lid is hinged together with the food container.

8. The utility lid of claim 1 wherein a portion of the second recess extending out past the second side of the first recess is larger than a portion of the recess extending out past the first side of the first recess, and wherein the second recess extending out past the second side of the first recess is configured to further accept a condiment receptacle.

9. A single use utility lid for a food container comprising:

a transparent lid having an inside and an outside and means for engaging the food container;

a first recess accessible from the outside of the transparent lid, the first recess having one or more retaining ridges, wherein the first recess is configured to retain a fork or spoon type utensil therein such that when retained therein the fork or spoon type utensil is substantially flush with or below a top surface of the lid;

a second recess connected to the first recess, wherein the second recess is disposed at about mid-length of the first recess, and wherein outer opposing edges of the second recess extends out past a first and second side of the first recess, and further wherein the second recess has a depth deeper than the depth of the first recess at that point, and further wherein the portions of the second recess extending out past the first side and the second side of the first recess are each configured to receive a portion of a user's fingertip therein;

a lid rim; and a third recess accessible from the outside of the transparent plastic lid, wherein the third recess is configured to accept a condiment receptacle therein.

10. The utility lid of claim 9 wherein the utility lid is hinged together with the food container.

11. A single use utility lid for a food container comprising:

a transparent plastic lid having an inside and an outside and means for engaging the food container, the transparent plastic lid further having a top portion and at least one side portion extending generally downward about a periphery of the top portion; and at least one utensil clip attached to at least one side portion along the outside of the transparent plastic lid, the utensil clip oriented to oppose the at least one side portion, wherein the utensil clip is configured to extend vertically upward and parallel to an outside facing surface of the at least one side portion, and wherein a gap is formed between at least a portion of a lid facing surface of the utensil clip and the outside facing surface of the at least one side portion, and further wherein an upper most portion of the utensil clip is not connected to the lid.

12. The utility lid of claim 11 wherein the utility lid is hinged together with the food container.

* * * * *